United States Patent [19]

Ishikawa et al.

[11] Patent Number: 4,687,731

[45] Date of Patent: Aug. 18, 1987

[54] METHOD FOR PROCESSING LIGHT-SENSITIVE SILVER HALIDE COLOR PHOTOGRAPHIC MATERIAL WHICH CONTAINS A HIGH SPEED REACTIVE YELLOW COUPLER BY PROCESSING, AFTER FIXINGS, WITH A SULFITE-CONTAINING SOLUTION AND WITHOUT SUBSTANTIAL WASHING

[75] Inventors: Masao Ishikawa; Shigeharu Koboshi; Satoru Kuse, all of Hino, Japan

[73] Assignee: Konishiroku Photo Industry Co., Ltd., Tokyo, Japan

[21] Appl. No.: 794,642

[22] Filed: Nov. 4, 1985

[30] Foreign Application Priority Data

Nov. 14, 1984 [JP] Japan ..... 59-241491

[51] Int. Cl.[4] ..... G03C 7/32; G03C 3/00; G03C 11/00; G03C 1/46

[52] U.S. Cl. ..... 430/372; 430/388; 430/398; 430/428; 430/429; 430/463; 430/611

[58] Field of Search ..... 430/372, 611, 388, 398, 430/428, 429, 463

[56] References Cited

U.S. PATENT DOCUMENTS 4,567,135 1/1986 Arakawa et al. ..... 430/505

*Primary Examiner*—John E. Kittle
*Assistant Examiner*—Mukund J. Shah
*Attorney, Agent, or Firm*—Frishauf, Holtz, Goodman & Woodward

[57] ABSTRACT

A method of processing a light-sensitive silver halide color photographic material comprising color developing an imagewise exposed light-sensitive silver halide color photographic material comprising a blue-sensitive silver halide emulsion layer, a green-sensitive silver halide emulsion layer and a red-sensitive silver halide emulsion layer on a base, said blue-sensitive silver halide emulsion layer containing a high speed reactive yellow coupler having a relative coupling reaction rate of not less than 0.3, followed by processing with a processing solution having a fixing ability and then processing with a stabilizing solution without a substantial washing step, said stabilizing solution containing a sulfite in an amount of at least $1\times10^{-3}$ mole per 1 liter of said stabilizing solution. The processed photographic material has superior stability of the dye image.

19 Claims, No Drawings

METHOD FOR PROCESSING LIGHT-SENSITIVE SILVER HALIDE COLOR PHOTOGRAPHIC MATERIAL WHICH CONTAINS A HIGH SPEED REACTIVE YELLOW COUPLER BY PROCESSING, AFTER FIXINGS, WITH A SULFITE-CONTAINING SOLUTION AND WITHOUT SUBSTANTIAL WASHING

BACKGROUND OF THE INVENTION

This invention relates to a lightsensitive silver halide color photographic material, and more particularly to a method for processing a lightsensitive silver halide color photographic material which can form a dye image having an excellent storage stability to a prolonged storage after processing with omission of a washing process step.

In general, a lightsensitive silver halide color photographic material (hereinafter referred to as a lightsensitive material) comprises a base or support having coated thereon 3 types of photographic silver halide emulsion layers which are selectively subjected to optical sensitizations so as to have lightsensitivities to blue light, green light and red light respectively. In such lightsensitive material, there is employed as a color developing agent, for example, an aromatic primary amine color developing agent to develop exposed silver halide grains and a dye image can be then formed by the reaction of the so-produced oxidized product of the color developing agent with a dye-forming coupler. In this method, a phenol- or naphthol-cyan coupler, a 5-pyrazolone-, pyrazolinobenzimidazole-, pyrazolotriazole-, indazolone- or cyanoacetyl-magenta coupler and an acylacetamido- or benzoylmethane-yellow coupler are usually employed for forming cyan, magenta and yellow dye images, respectively.

Where such couplers are to be applied to a lightsensitive material, it is generally known that a coated silver amount can be reduced by the use of a high speed reactive coupler. It is also known that use of a high speed reactive coupler is very much favourable with regard to enhancement of desilverization, improvement in poor color recovery and further rapid processing.

Particularly, in a lightsensitive material for color photographic paper, it may be readily inferred that rapid processing or processing stability may be greatly improved by applying a high speed reactive yellow coupler to a blue-sensitive silver halide emulsion layer which is coated over the base at the nearest portion thereof and is most required for improved developability.

However, it has been found as a result of the present inventor's studies that, when a lightsensitive material with a high speed reactive yellow coupler is processed, there is presented the problem which optical discoloration of the yellow dye image after processing and lowered density at a high temperature and a high humidity tend to bring about easily. Moreover, the present inventors have found that there may be readily brought about such a poor storage property with time in the yellow dye image, particularly when there are conducted color development, bleach-fix and washing.

SUMMARY OF THE INVENTION

It is, accordingly, a primary object of this invention to provide a processing method wherein a lightsensitive material containing a high speed reactive yellow coupler can be processed to produce a dye image having a superior stability with the passage of time.

As a result of our intensive studies, it has been found that the object of this invention can be achieved by, in a method of processing a lightsensitive silver halide color photographic material comprising subjecting a lightsensitive silver halide color photographic material comprising a blue-sensitive silver halide emulsion layer, a green-sensitive silver halide emulsion layer and a red-sensitive silver halide emulsion layer provided on a base, said blue-sensitive silver halide emulsion layer containing a high speed reactive yellow coupler having a relative coupling reaction rate of not less than 0.3, to color development, followed by processing with a processing solution having a fixing ability and then processing with a stabilizing solution without involving any substantial washing step, the improvement wherein said stabilizing solution contains at least $1\times10^{-3}$ mole of a sulfite per 1 liter of said stabilizing solution.

DESCRIPTION OF THE PREFERRED EMBODIMENTS

In this invention, stability of dye image can be greatly improved by processing with a stabilizing solution involving a sulfite even when a slight amount of any other chemicals remains in a lightsensitive photographic material. Thus, the washing step may be reduced or eliminated.

It has been hitherto considered that a prolonged storage property of a photographic image would be deteriorated when a large amount of components of a fixing or bleach-fix solution or soluble silver salts or decomposition products thereof would remain in a lightsensitive material. As a matter of fact, sufficient washing has been made for removing said salts and decomposition products from a lightsensitive material.

However, it is quite unexpected to the present inventors that a favourable image storage property can be obtained and, especially when a high speed reactive yellow coupler is employed, optical discoloration of an yellow dye image or decrease in density at a high temperature and a high humidity can be prevented.

This invention will be more fully explained below.

The high speed reactive yellow coupler, which may be employed for a blue-sensitive silver halide emulsion layer in this invention, is any of the yellow couplers having a relative coupling reaction rate of not less than 0.3, preferably 0.5 or more.

A coupling reaction rate of the coupler can be determined as a relative value by admixing two sorts of couplers M and N which may provide different dyes clearly separable each other, adding the resulting mixture to a silver halide emulsion, color-developing the emulsion and determining the respective dye amounts in the resultant color image.

When colorations at the maximum density and intermediate density are represented with $(DM)_{max}$ and DM in the coupler M and the corresponding colorations in the coupler N with $(DN)_{max}$ and DN, respectively, the ratio in reactivity of both couplers, RM/RN, may be represented according to the following formula:

$$\frac{RM}{RN} = \frac{\log\left(1 - \frac{DM}{(DM)\text{max.}}\right)}{\log\left(1 - \frac{DN}{(DN)\text{max.}}\right)}$$

That is to say, a silver halide emulsion containing the mixed couplers is subjected to various stepwise exposures and color-developed to give several pairs of DM and DN. Said pairs are plotted on rectangular two coordinate axes in terms of $$\log\left(1 - \frac{DM}{DM\text{max.}}\right) \text{ and } \log\left(1 - \frac{DN}{DN\text{max.}}\right),$$

whereby a coupling activity ratio, the RM/RN value, can be determined from the gradient of the resultant line.

When the RM/RN value is determined as described above for various couplers by the use of a certain coupler N, a relative value of the coupling reaction rate can be determined.

In this invention, there is applied the RM/RN values where the under-mentioned coupler is employed as the coupler N.

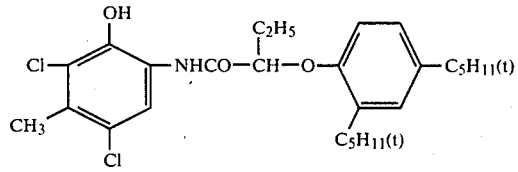

An amount of the high speed reactive yellow coupler of this invention to be added is not critical, but it is usually $2\times10^{-3}$ to $5\times10^{-1}$ mole per mole of the silver in a blue-sensitive silver halide emulsion layer, preferably $1\times10^{-2}$ to $5\times10^{-1}$ mole.

Exemplary examples of the high speed reactive yellow coupler employed in this invention will be given below, but they are not intended to be limitative.

[Exemplary Compound]

(Y-1)

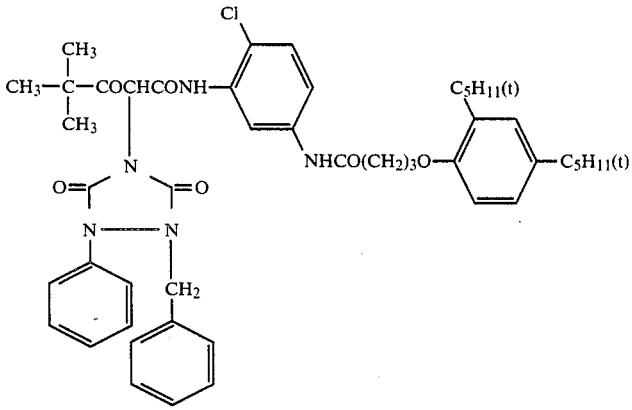

(RM/RN = 0.80)

(Y-2)

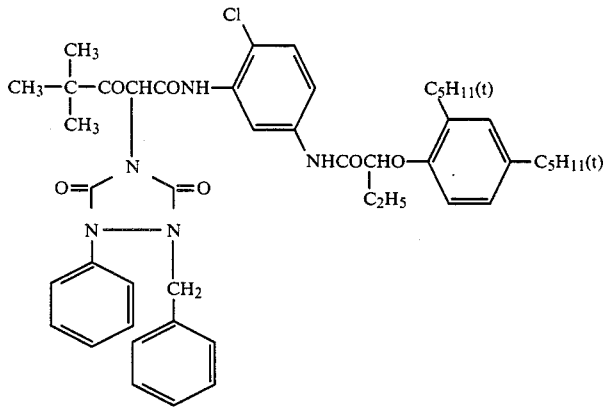

(RM/RN = 0.84)

-continued
(Y-3)
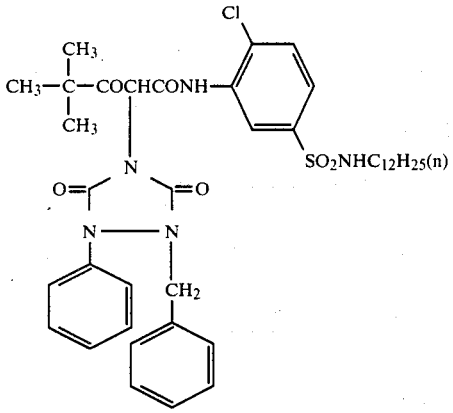
(RM/RN = 1.01)
(Y-4)
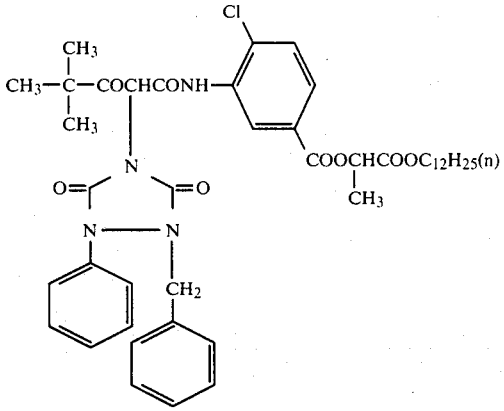
(RM/RN = 1.45)
(Y-5)
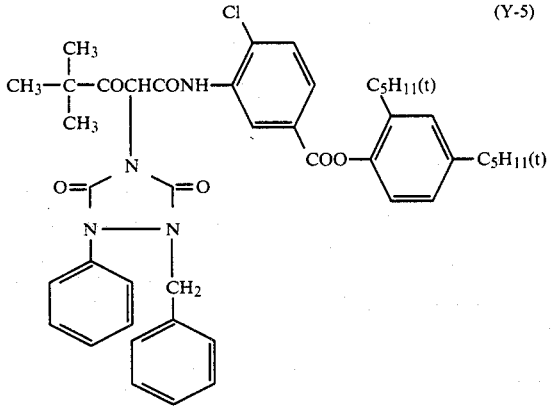
(RM/RN = 1.03)
(Y-6)
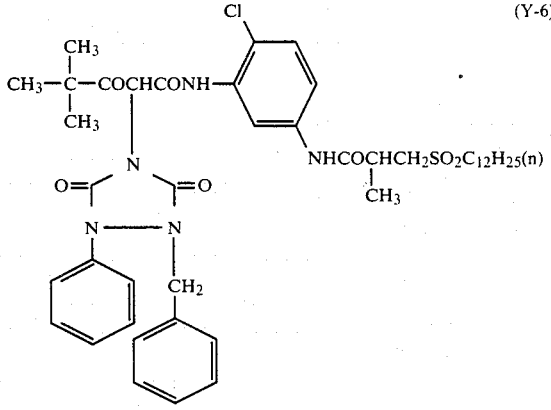
(RM/RN = 0.95)
(Y-7)
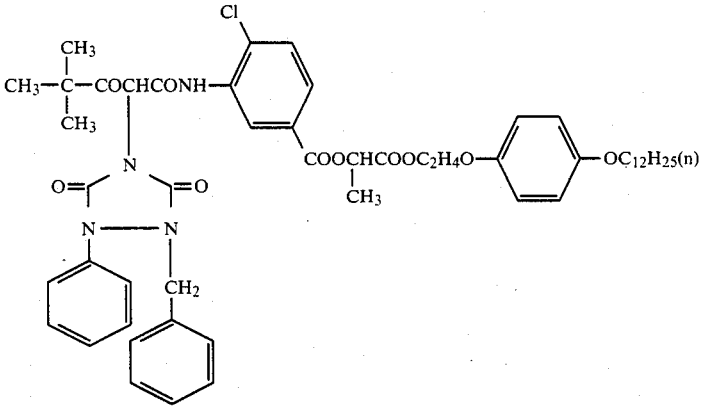
(RM/RN = 1.28)
(Y-8)
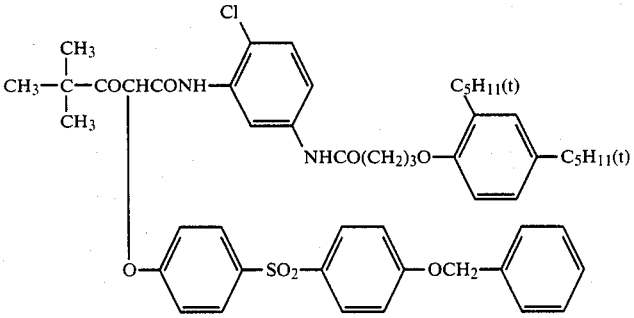
(RM/RN = 0.65)

-continued
(Y-9)
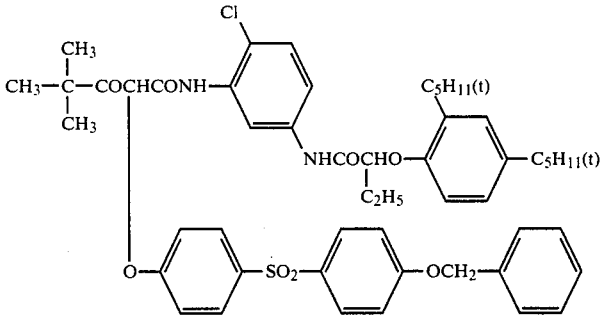
(RM/RN = 0.92)
(Y-10)
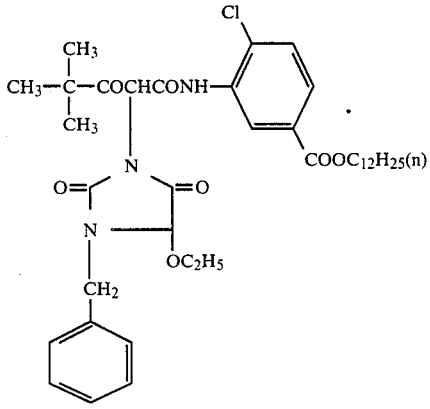
(RM/RN = 1.48)
(Y-11)
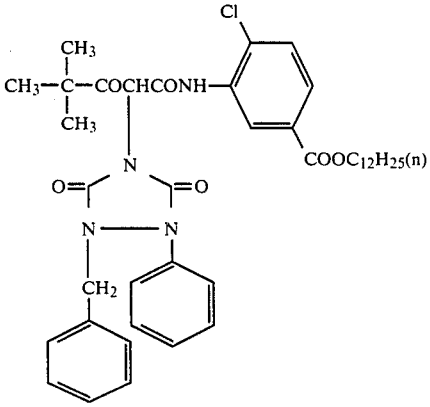
(RM/RN = 1.32)
(Y-12)
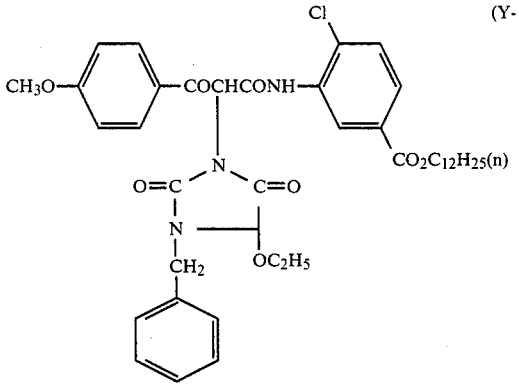
(RM/RN = 1.46)
(Y-13)
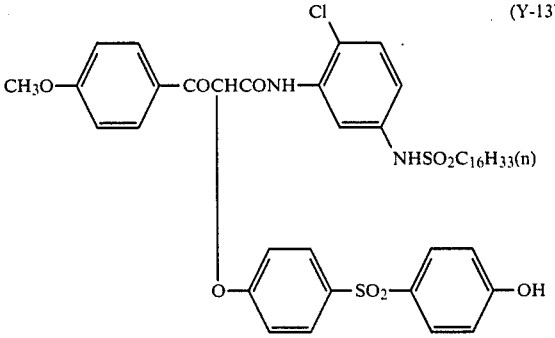
(RM/RN = 1.27)
(Y-14)
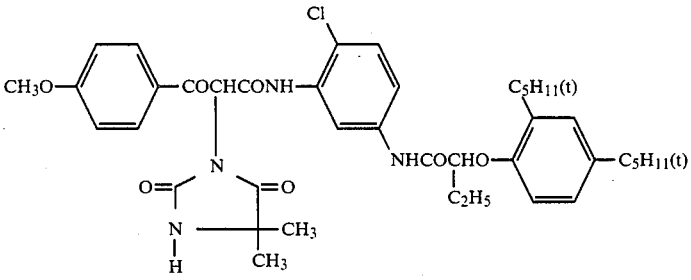
(RM/RN = 0.96)

-continued
(Y-15)
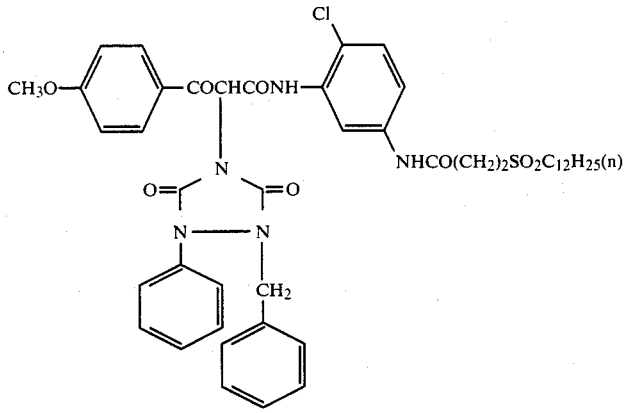
(RM/RN = 0.81)
(Y-16)
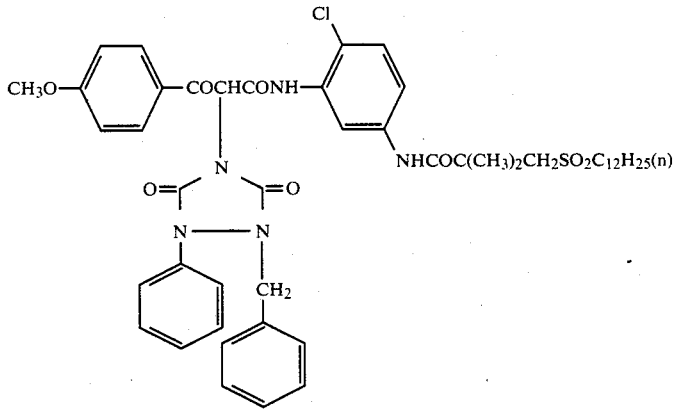
(RM/RN = 0.76)
(Y-17)
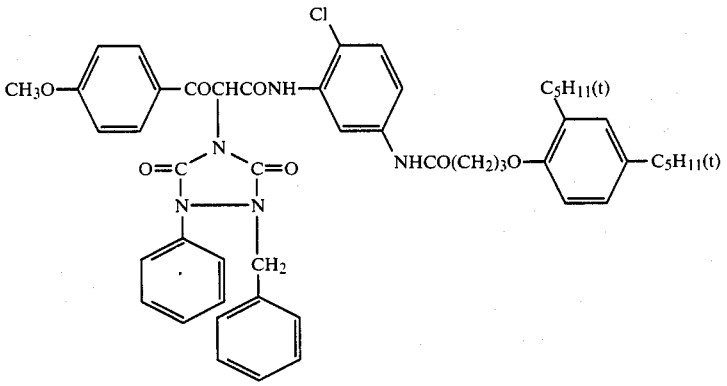
(RM/RN = 0.99)
(Y-18)
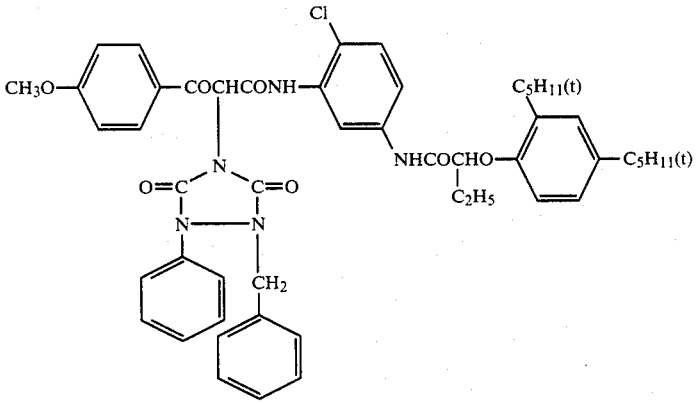
(RM/RN = 0.94)

-continued
(Y-19)
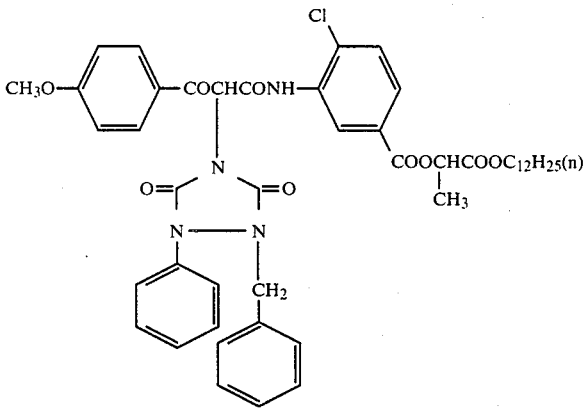
(RM/RN = 1.40)
(Y-20)
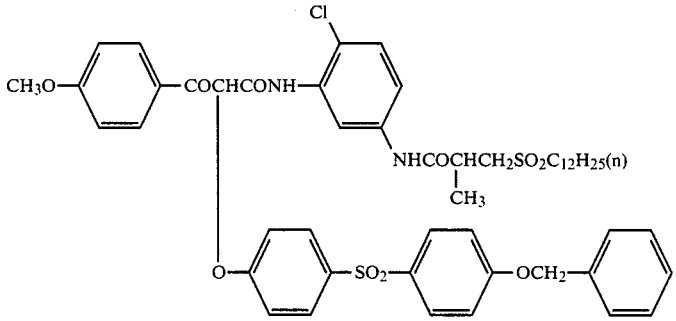
(RM/RN = 0.88)
(Y-21)
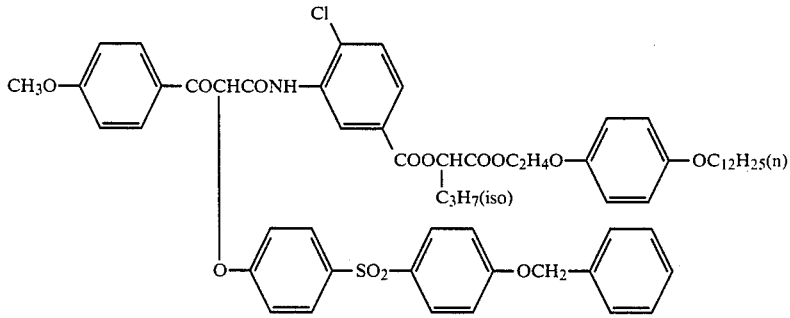
(RM/RN = 1.19)
(Y-22)
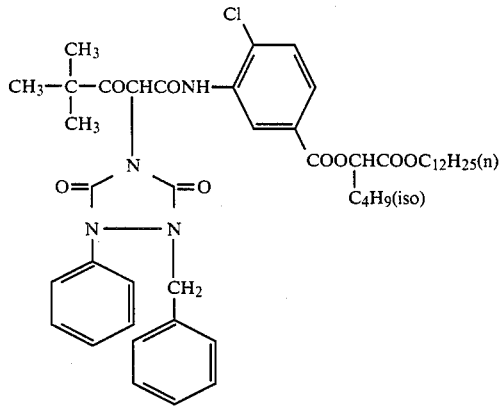
(RM/RN = 1.48)

-continued
(Y-23)
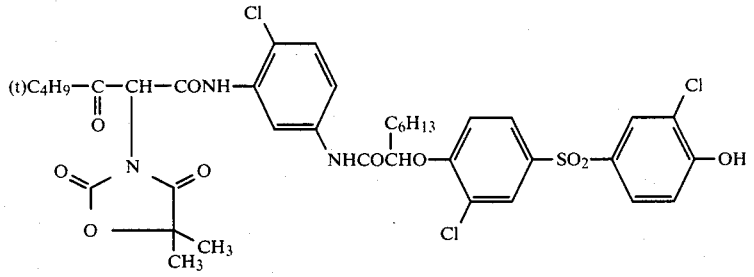
(RM/RN = 0.66)
(Y-24)
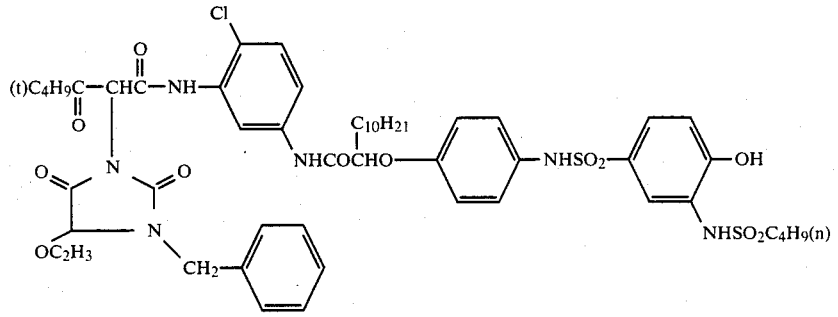
(RM/RN = 0.82)
(Y-25)
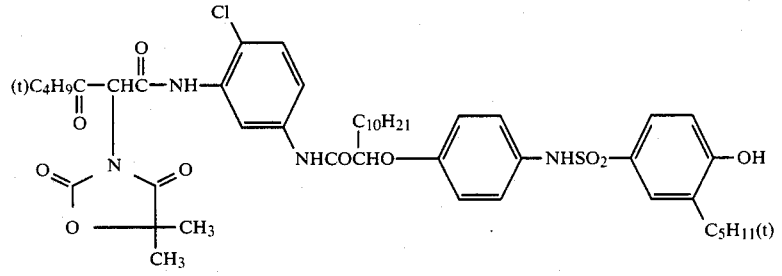
(RM/RN = 0.71)
(Y-26)
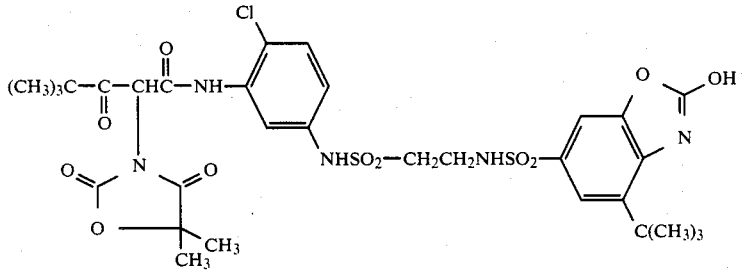
(RM/RN = 0.53)
(Y-27)
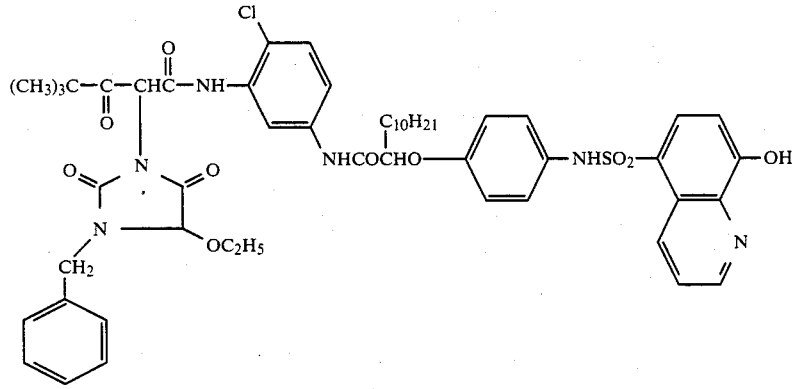
(RM/RN = 0.42)

-continued
(Y-28)
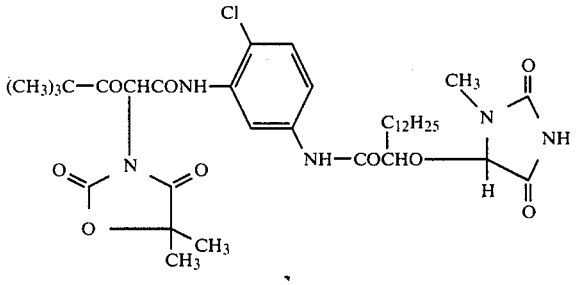
(RM/RN = 0.42)
(Y-29)
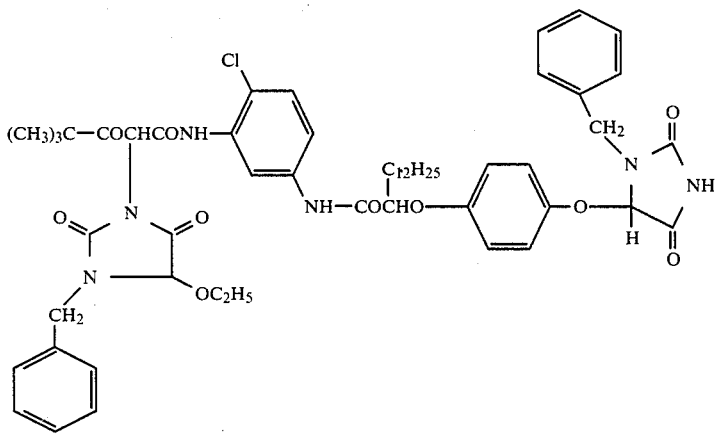
(RM/RN = 0.58)
(Y-30)
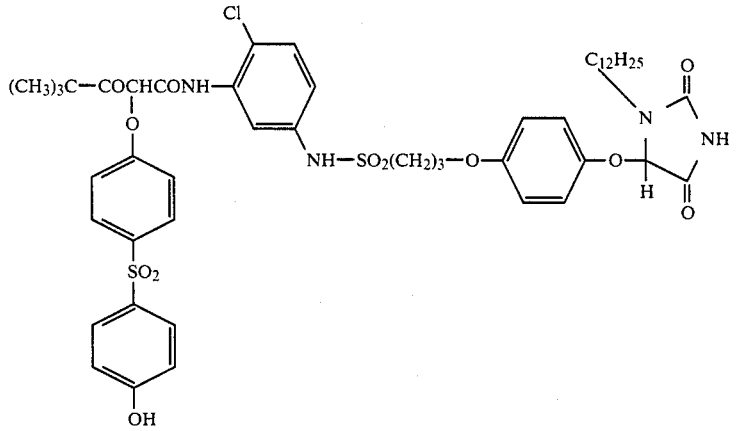
(RM/RN = 1.28)
(Y-31)
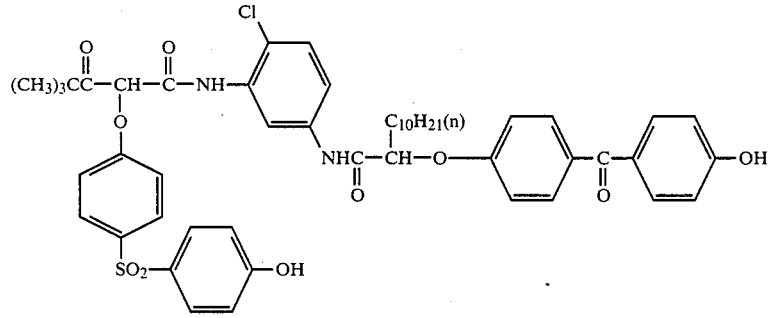
(RM/RN = 0.75)

-continued
(Y-32)
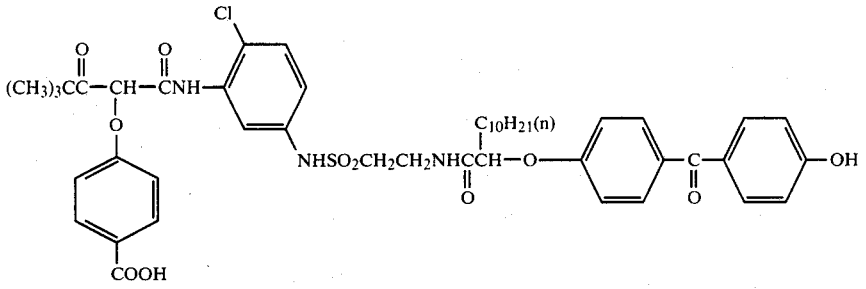
(RM/RN = 0.92)
(Y-33)
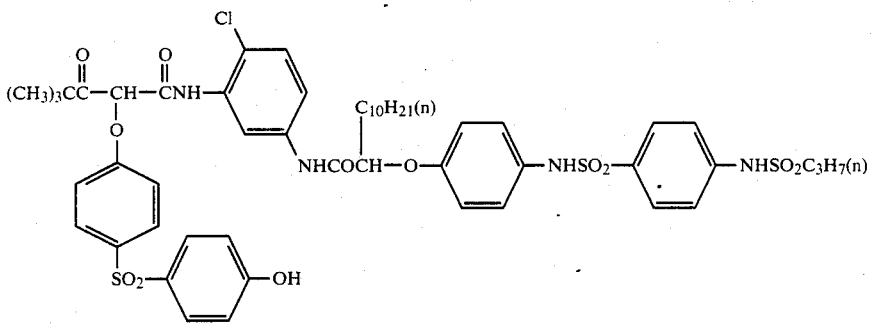
(RM/RN = 0.85)
(Y-34)
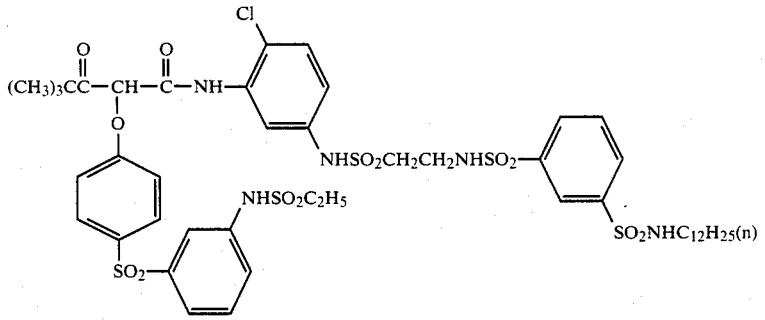
(RM/RN = 1.15)
(Y-35)
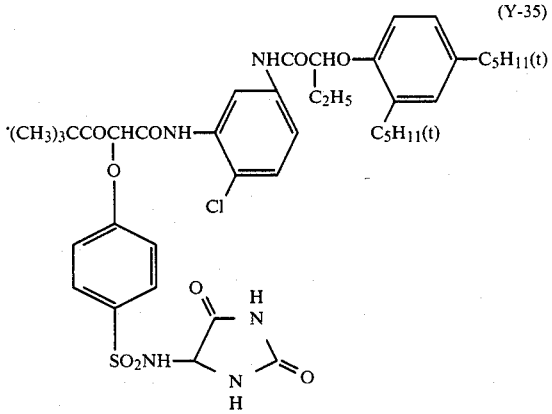
(RM/RN = 0.42)
(Y-36)
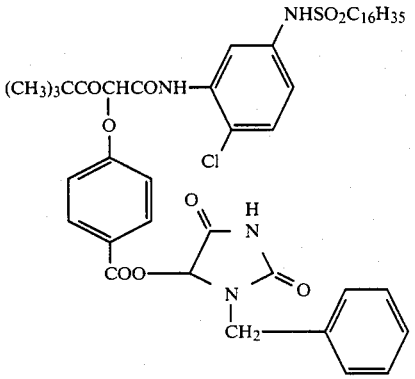
(RM/RN = 0.80)

-continued (Y-37)

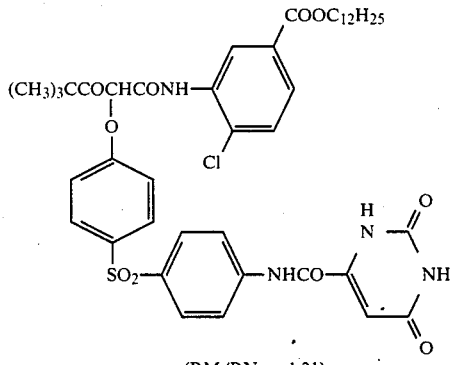

(RM/RN = 1.21)

(Y-38)

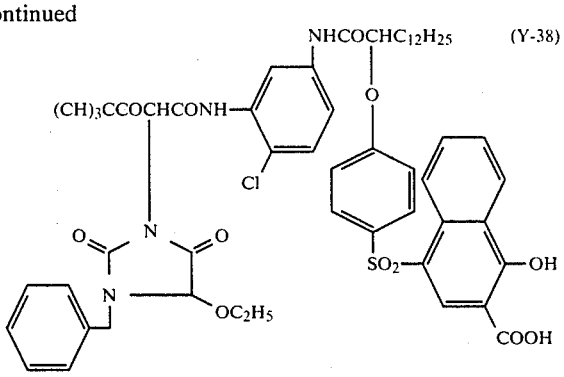

(RM/RN = 0.6)

(Y-39

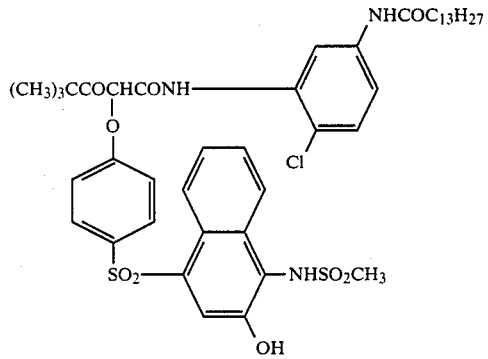

(RM/RN = 0.9)

The blue-sensitive silver halide emulsion layer of this invention may include the present high speed reactive yellow coupler and said blue-sensitive silver halide emulsion layer may also include other yellow coupler than the present one, provided that other yellow coupler than the present one may be preferably involved at less than 45 mole % based on a total amount of yellow couplers.

In this invention, as the coupler, there may be employed any yellow couplers, magenta couplers and cyan couplers well known in the art. These couplers may be either of the so-called divalent type or tetravalent type couplers and a diffusible, dye-releasing coupler and the like may be employed in combination with the above coupler.

As the above-mentioned yellow coupler, there may be employed without any particular limitation closed ketomethylene compounds as well as such so-called divalent type couplers as active site o-aryl substituted couplers, active site o-acyl substituted couplers, active site hydantoin compound substituted couplers, active site urazol compound substituted couplers and active site succinimide compound substituted couplers, active site fluorine substituted couplers, active site chlorine substituted couplers, active site bromine substituted couplers, active site o-sulfonyl substituted couplers and the like.

As the magenta coupler which may be employed in this invention, there may be mentioned pyrazolone-, pyrazolotriazole-, pyrazolinobenzimidazole- or indazolone-compounds. The magenta coupler may be either of a tetravalent type or a divalent type, as the yellow coupler. As exemplary examples of the magenta coupler, there may be mentioned those as disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,981,445; West German Pat. No. 18 10 464, West German laid-open Patent Applications (OLS) Nos. 24 08 665, 24 17 945, 24 18 959 and 24 24 467; Japanese Patent Publication No. 40-6031; Japanese Unexamined Patent Publications Nos. 51-20826, 52-58922, 49-129538, 49-74027, 50-159336, 52-42121, 49-74028, 50-60233, 51-26541 and 53-55122, and so on.

Further, as the useful cyan couplers which may be employed in this invention, there may be mentioned, for example, phenol- and naphthol-couplers, etc. Such cyan couplers may be either of a four-equivalent type or of a two-equivalent type as the yellow couplers. As exemplary examples of the cyan coupler, there may be mentioned those as disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929; West German laid-open Patent Applications (OLS) Nos. 24 14 830 and 24 54 329; Japanese Unexamined Patent Publications Nos. 48-59838, 51-26034, 48-5055, 51-146827, 52-69624, 52-90932 and 58-95346 and so on.

For incorporating the high speed reactive yellow coupler of this invention and other couplers into the silver halide emulsion of this invention, if said coupler is alkali-soluble, it may be incorporated in the form of its alkaline solution, while if oil-soluble, said coupler may preferably be dissolved in a high boiling point solvent, if necessary, together with a low boiling point solvent, and dispersed in a fine powder form to add into a silver halide emulsion according to the methods as described in U.S. Pat. Nos. 2,272,191, 2,304,940, 2,322,027, 2,801,170 and 2,801,171. Also, there may be employed a mixture of two or more of couplers. Moreover, there may be given below a preferable method for the incorporation of a coupler in this invention: One or two or more of said couplers, if necessary, together with other couplers may be dissolved in a high boiling point solvent and/or a low boiling point solvent, said high boiling point solvent being an organic acid amide, a carbamate, an ester, a ketone, a urea derivative, an ether, a hydrocarbon and the like, particularly, di-n-butyl phthalate, tricresyl phosphate, triphenyl phosphate, diisooctyl azelate, di-n-buty sebacate, tri-n-hexyl phosphate, N,N-diethyl-caprylamidobutyl, N,N-diethyl-laurylamide, n-pentadecyl phenyl ether, dioctyl phthalate, n-nonylphenol, 3-pentadecyl phenyl ethyl ether, 2,5-di-sec-amylphenyl butyl ether, monophenyl di-o-chlorophenyl phosphate or fluorinated paraffin and said low-boiling solvent being methyl acetate, ethyl acetate, propyl acetate, butyl acetate, butyl propionate, cyclohexanol, diethylene glycol monoacetate, nitromethane, carbon tetrachloride, chloroform, cyclohexane, tetrahydrofuran, methyl alcohol, acetonitrile, dimethylformamide, dioxane, methyl ethyl ketone, mixed with an aqueous solution containing an anionic surface active agent such as an alkylbenzenesulfonic acid and an alkylnaphthalenesulfonic acid and/or a nonionic surface active agent such as a sorbitan sesquioleic acid ester and a sorbitan monolaurylic acid ester and/or a hydrophilic binder such as gelatin and the like, emulsified and dispersed by means of a high speed rotary mixer, a colloid mill or an ultrasonic dispersing apparatus and the like.

Also, the above coupler may be dispersed by means of a latex dispersing method. A latex dispersing method and effects thereof are described in Japanese Unexamined Patent Publications Nos. 49-74538, 51-59943 and 54-32552 and Research Disclosure, 1976, August, No. 14850, pages 77 to 79.

Suitable latexes may include, for example, homopolymers, copolymers and terpolymers of such monomers as styrene, acrylates, n-butyl acrylate, n-butyl methacrylate, 2-acetoacetoxyethyl methacrylate, 2-(methacryloyloxy)ethyl trimethylammonium methosulfate, 3-(methacryloyloxy)propane-1-sulfonic acid sodium salt, N-isopropylacrylamide, N-[2-(2-methyl-4-oxopentyl)]acrylamide, 2-acrylamido-2-methylpropanesulfonic acid and the like.

Other various photographic additives may be also contained in the lightsensitive material of this invention. For instance, there may be employed an antifoggant, a stabilizer, an ultraviolet absorber, a brightening agent, an antistatic agent, a hardening agent, a surface active agent, a plasticizer, a wetting agent and the like as described in research disclosure No. 17643.

The silver halide emulsion which may be employed in the lightsensitive material of this invention may be any of such silver halides as silver chloride, silver bromide, silver iodide, silver chlorobromide, silver chloroiodide, silver iodobromide and silver chloroiodobromide.

In the lightsensitive material of this invention, the hydrophilic colloid which may be employed for preparing an emulsion may include any of gelatin, a gelatin derivative, a graft polymer of gelatin with other polymer, a protein, e.g., alubmin, or casein, a hydroxyethyl cellulose derivative, a cellulose derivative, e.g., carboxymethyl cellulose, a starch derivative, a synthetic hydrophilic polymer of a monopolymer or copolymer, e.g., polyvinyl alcohol, polyvinylimidazole, polyacrylamide and the like.

As the base for the lightsensitive material of this invention, there may be mentioned, for example, a baryta paper, a polyethylene-coated paper, a polypropylene synthetic paper, a transparent base with a reflective layer or using a reflective layer, e.g., a glass plate, cellulose acetate, cellulose nitrate, a polyester film such as polyethylene terephthalate, a polyamide film, a polycarbonate film, a polystyrene film and the like and such base may be optionally selected upon the purposes of utilization of the lightsensitive materials.

In the present invention, the version "subsequently processing with a stabilizing solution without involving a substantial washing step" is meant to indicate "processing with a stabilizing solution according to a single tank or multiple tank countercurrent system immediately after processed with a processing solution having a fixing ability", but said processing may include other processing step than general washing such as rinsing, auxiliary washing and well-known washing-promoting bath.

In the stabilization step of this invention, processing of a lightsensitive material with a stabilizing solution may be accomplished by contacting the stabilizing solution with the lightsensitive material and procedures therefor may be preferably done by dipping the lightsensitive material into a bath in the same manner as done with a general processing solution but may also be done by coating the emulsion side of a lightsensitive material and both sides of a convey leader or a convey belt with a sponge, a synthetic fiber cloth and the like or by spraying with a sprayer and the like.

The instance wherein we employ a stabilizing bath according to a dipping method will be mainly explained hereinbelow.

The stabilizing solution of this invention is meant to indicate a processing solution which is to be applied after a processing solution having a fixing ability and has an amount to replenished of not more than 50 ml per 100 $cm^2$ of a lightsensitive material. Even water may be employed as a stabilizing solution, provided that the above-defined requirements may be met.

As the sulfite which may be contained in a stabilizing solution in this invention, there may be given such compounds as sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, glutaraldehyde bis-sodium bisulfite, succinaldehyde bis-sodium bisulfite and the like, but one may employ any of those compounds capable of releasing a sulfite ion.

The above sulfite may be added into the stabilizing solution at least $1\times10^{-3}$ mole/l, preferably not more than 0.1 mole/l. If more than 0.1 mole/l of the sulfite, optical discoloration undesirably tends to be deteriorated in an yellow dye image or bacteria tend to grow readily. If less than $1\times10^{-3}$ mole/l, a lowered yellow dye density could not effectively prevented.

It is preferable in this invention that a stabilizing solution contains a chelating agent having a chelate stability constant to an iron ion of not less than 6.

The chelate stability constant as used herein is meant to be the generally known constant as shown in "Stability Constants of Metal-ion Complexes", The Chemical Society, London (1964), by L. G. Sillen and A. E. Martell and "Organic Sequestering Agents", Wiley (1959), by S. Chaberek and A. E. Martell.

As the chelating agent which has a chelate stability constant to an iron ion of not less than 6, there may be given an organic carboxylic acid chelating agent, an organic phosphoric acid chelating agent, an inorganic phosphoric acid chelating agent, a polyhydroxy compound and the like.

The term "iron ion" as used is meant to be a ferric ion ($Fe^{3+}$).

As illustrative examples of the chelating agent having a chelate stability constant to a ferric ion of not less than 6, there may be given the following compounds, which are non-limiting. Namely, ethylenediamineorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclohexanediaminetetraacetic acid, glycol ether diaminetetraacetic acid, ethylenediaminetetrabismethylenephosphonic acid, nitrilotrimethylenephosphonic acid, 1-hydroxyethylidene-1,1-diphosphonic acid, 1,1diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphonate, sodium hexametaphosphonate are given, with diethylenetriaminepentaacetic acid, nitrilotriacetic acid, 1-hydroxyethylidene-1,1-diphosphonic acid and salts thereof being particularly preferable.

An amount of the above chelating agent to be used is usually 0.01 to 50 g per liter of a stabilizing solution and preferably a range of 0.05 to 20 g to give favourable results.

As the compound which may be desirably added to the stabilizing solution of this invention, there may be given a mildewcide, a water-soluble metal salt, and an ammonium compound.

As the mildewcide, there may be employed, for example, isothiazoline-, benzimidazole-, benzisothiazoline-, thiabendazole- or phenol-compounds, organic halogen-substituted compounds, mercapto compounds, benzoic acid and derivatives thereof and the like and, preferably, there may be mentioned isothiazoline-, benzisothiazoline-, thiabendazole- or phenol-compounds, benzoic acid and the like, with isothiazoline-, benzisothiazoline- and thiabendazole-compounds being particularly preferable.

There will be given hereinbelow the illustrative examples of the above compounds, which are, however, not limited of the invention.

[Exemplary Compounds]

(1) 2-Methyl-4-isothiazoline-3-one
(2) 5-Chloro-2-methyl-4-isothiazoline-3-one
(3) 2-Methyl-5-phenyl-4-isothiazoline-3-one
(4) 4-Bromo-5-chloro-2-methyl-4-isothiazoline-3-one
(5) 2-Hydroxymethyl-4-isothiazoline-3-one
(6) 2-(2-Ethoxyethyl)-4-isothiazoline-3-one
(7) 2-(N-methylcarbamoyl)-4-isothiazoline-3-one
(8) 5-(Bromomethyl-2-(N-dichlorophenylcarbamoyl)-4-isthiazoline-3-one
(9) 5-Chloro-2-(2-phenylethyl)-4-isothiazoline-3-one
(10) 4-Methyl-2-(3,4-dichlorophenyl)-4-isothiazoline-3-one
(11) 1,2-Benzoisothiazoline-3-one
(12) 2-(2-Bromoethyl)-1,2-benzoisothiazoline-3-one
(13) 2-Methyl-1,2-benzoisothiazoline-3-one
(14) 2-Ethyl-5-nitro-1,2-benzoisothiazoline-3-one
(15) 2-Benzyl-1,2-benzoisothiazoline-3-one
(16) 5-Chloro-1,2-benzoisothiazoline-3-one With regard to these exemplary compounds, synthetic method and applications to other technical fields thereof are disclosed in U.S. Pat. Nos. 2,767,172, 2,767,173, 2,767,174 and 2,870,015; British Patent No. 848,130; French Patent No. 1,555,416 and so on. Some of the exemplary compounds are commercially available, e.g., under the tradename of Topside 300, Topside 600 (manufactured by Permachem Asia Co., Ltd.), Fineside J-700 (manufactured by Tokyo Fine Chemical K.K.) or Proxel GXL (manufactured by I.C.I.).

An amount of the above compound to be used is usually in the range of 0.01 to 50 g per liter of a stabilizing solution and favourable results could be given preferably with 0.05 to 20 g.

As the water-soluble metal salt, there may be mentioned salts of such metals as Ba, Ca, Ce, Co, In, La, Mn, Ni, Pb, Sn, Zn, Ti, Zr, Mg, Al or Sr and they may be supplied in the form of the corresponding halide, hydroxide, inorganic salt, e.g., sulfate, carbonate, phosphate, acetate and the like or water-soluble chelating agent. An amount of the salt to be used is in the range of $1\times10^{-4}$ to $1\times10^{-1}$ mole per liter of a stabilizing solution, preferably $4\times10^{-4}$ to $2\times10^{-2}$ mole, more preferably $8\times10^{-4}$ to $1\times10^{-2}$ mole.

In addition to the aforesaid compounds, there may be further added optionally to the stabilizing solution of this invention such additives as brightening agents; organic sulfur compounds; onium salts; hardening agents; uneven droplet inhibitors, e.g., quarternary salts, polyethylene oxide derivatives, siloxane derivatives and the like; pH adjustors, e.g., boric acid, citric acid, phosphoric acid, acetic acid, sodium hydroxide, sodium acetate, potassium citrate and the like; organic solvents, e.g., methanol, ethanol, dimethyl sulfoxide and the like; dispersing agents, e.g., ethylene glycol, polyethylene glycol and the like; as well as tone adjustors and various additives to improve or expand processing effects.

A supply method of a stabilizing solution in the stabilizing step of this invention is preferably, in the case of a multi-tank, countercurrent system, to supply to a post-bath and overflow from a pre-bath. Also, for adding the sulfite, there may be various processes to add a concentrated solution thereof into a stabilization tank, to add the above compounds and other additives to the stabilizing solution to be fed into a stabilizing tank and then use the resultant as a supply liquid to a stabilizing solution or to add the sulfite into the lightsensitive material to be processed by adding to a pre-bath prior to the stabilization step and then place in a stabilizing tank; and there may be employed any of those processes for incorporation. However, it is preferred during process to use as a replenisher for the stabilizing solution, a solution which contains the sulfite in an amount of at least $1\times10^{-3}$ mole/liter.

A pH value of the processing solution for each of the above-mentioned stabilizing baths in this invention is preferably in the range of pH 4 to 8. If pH is lower than 4, silver sulfide tends to be produced and there may be presented such problems as clogging of filter and others. If pH is higher than 8, fur or bacteria are apt to be readily produced or grown. Therefore, the present stabilizing bath can be applied with a pH range of 4 to 8.

Further, pH adjustment may be accomplished with the above-mentioned pH adjustor.

Processing temperature for stabilization is in the range of 15° to 60° C., preferably 20° to 45° C. Processing period of time is preferable as short as possible in view of rapid processing, usually 20 seconds to 10 minutes, most preferably 1 to 5 minutes. It is preferred that the more former tanks may be processed in a shorter time and the more latter tanks may be processed in a longer time.

There is not at all required any washing process before or after the stabilization process of this invention, but there may be provided a rinsing by washing with a small volume of water within an extremely short period, a surface washing by sponge, etc. and a processing tank for stabilization of image or for control of surface properties of a lightsensitive material. For said stabilization of image or control of surface properties of a lightsensitive material, there may be employed such activating agents as formalin and derivatives thereof, siloxane derivatives, polyethylene oxide compounds, quaternary salts and the like.

The aromatic primary amine color developing agent, which may be employed in the color developing solution applied for color development in this invention, may include any well-known agents widely employed for various color photographic processings. Such developing agent may include amino phenol- and p-phenylenediamine derivatives. These compounds may be generally used in the form of a salt thereof, e.g., hydrochloride or sulfate, because of there are more stable than the free form. The compound may be generally employed at a concentration of approximately 0.1 to 30 g per liter of the color developing solution, preferably approximately 1 to 1.5 g.

As the aminophenol developing agent, there may be given, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino color developing agents may include N,N'-dialkyl-p-phenylenediamine compounds wherein alkyl and phenyl groups may be optionally substituted with any substituents. Of these compounds, examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate and so on.

The color developing solution which may be employed in the process of this invention may optionally include, in addition to the aforesaid primary aromatic amine color developing agent, a wide variety of components commonly added to a color developing solution, for example, an alkali agent such as sodium hydroxide, sodium carbonate, potassium carbonate, an alkali metal sulfite, an alkali metal bisulfite, an alkali metal thiocyanate, an alkali metal halide, benzyl alcohol, a water softener and a thickner. The color developing solution has generally a pH value of 7 or higher, most generally approximately 10 to 13.

In the present invention, processing may be conducted with a processing solution having a fixing ability after color development and, where said processing solution having a fixing ability is a fixing solution, bleach-processing is conducted prior to said process.

As the bleaching solution which may be employed in the bleaching or the bleaching agent applied in said bleach-fix solution, there may be used a metal complex salt of an organic acid and said metal complex salt can show the action to oxidize a metallic silver as produced by developing into a silver halide, simultaneously with coloration of the uncolored portion of a coloring agent. The metal complex salt has a structure of an organic acid such as aminopolycarboxylic acid, oxalic acid, citric acid coordinated with a metal ion such as iron, cobalt, copper. As the most preferable organic acid which may be employed for production of such organic acid metal complex salt, there may be given a polycarboxylic acid or an aminopolycarboxylic acid and such polycarboxylic acid or aminopolycarboxylic acid may be in the form of the corresponding alkali metal salt, ammonium salt or water-soluble amine salt.

Typical examples thereof may be illustrated as follows:

(1) Ethylenediaminetetraacetic acid
(2) Diethylenetriaminepentaacetic acid
(3) Ethylenediamine-N-(β-oxyethyl)-N,N',N'-triacetic acid
(4) Propylenediaminetetraacetic acid
(5) Nitrilotriacetic acid
(6) Cyclohexanediaminetetraacetic acid
(7) Iminodiacetic acid
(8) Dihydroxyethyl glycinecitric acid or the corresponding tartaric acid
(9) Ethyl ether diaminetetraacetic acid
(10) Glycol ether diaminetetraacetic acid
(11) Ethylenediaminetetrapropionic acid
(12) Phenylenediaminetetraacetic acid
(13) Ethylenediaminetetraacetic acid disodium salt
(14) Ethylenediaminetetraacetic acid tetra(trimethylammonium)salt
(15) Ethylenediaminetetraacetic acid tetrasodium salt
(16) Diethylenetriaminepentaacetic acid pentasodium salt
(17) Ethylenediamine-N-(β-oxyethyl)-N,N',N'-triacetic acid sodium salt
(18) Propylenediaminetetraacetic acid sodium salt
(19) Nitrilotriacetic acid sodium salt
(20) Cyclohexanediaminetetraacetic acid sodium salt The bleaching solution as used may contain as a bleaching agent the aforesaid organic acid metal complex salt, as well as various additives. As the additive, there may be desirably incorporated therein, inter alia a rehalogenating agent such as an alkali halide or an ammonium halide, e.g., potassium bromide, sodium bromide, sodium chloride or ammonium bromide, a metal salt and a chelating agent. Further, there may be optionally added any of those known to be commonly added to a bleaching solution such as a pH buffering agent, e.g., borates, citrates, acetates, carbonates, phosphates and the like, an alkylamine, a polyethylene oxide and the like.

Moreover, a fixing solution and a bleach-fix solution may include a pH buffering agent, alone or in combination with the two or more thereof, e.g., such sulfite as ammonium sulfite, potassium sulfite, ammonium bisulfite, potassium bisulfite, sodium bisulfite, ammonium metabisulfite, potassium metabisulfite, sodium metabisulfite and the like, various salts of boric acid, borax, sodium hydroxide, potassium hydroxide, sodium carbonate, potassium carbonate, sodium bicarbonate, potassium bicarbonate, acetic acid, sodium acetate, ammonium hydroxide and the like.

Where the processing of this invention is to be carried out with replenishing a bleach-fix replenisher to a bleach-fix solution or bath, a thiosulfate, a thiocyanate or a sulfite and the like may be incorporated into said bleach-fix solution or bath or a bleach-fix replenisher having previously incorporated therein said salts may be replenished to a processing bath.

In order to enhance activity of a bleach-fix solution in this invention, it may be conducted, if desired, to blow air or oxygen through a bleach-fix bath and a storage tank for a bleach-fix replenisher or alternatively to incorporate optionally therein a suitable oxidizing agent, e.g., hydrogen peroxide, a hydrobromide or a persulfate, etc.

In the processing of this invention, one may recover silver from processing solutions containing soluble silver complex salts, e.g., a stabilizing solution and even a fixing solution and a bleach-fix solution according to any method well known per se. For instance, there may be effectively utilized an electrolysis method as disclosed in French Patent No. 2,299,667, a precipitation method as disclosed in Japanese Unexamined Patent Publication No. 52-73037 and West German Patent No. 23 31 220, an ion exchange method as disclosed in Japanese Patent Kokai Application No. 51-17114 and West German Patent No. 25 48 237 and a metal substitution method as disclosed in British Patent No. 1,353,805 and others.

[EXAMPLES]

This invention will be more fully explained by way of the following examples, but they are not intended to be limiting the embodiment of this invention.

EXAMPLE 1

A mixture was prepared from 4.0 g of the exemplary yellow coupler in this invention as indicated in the following Table 1 and the following comparative coupler (1) and (2), 2.5 g of a high boiling point solvent, dibutyl phthalate (hereinafter referred to as DBP), and 20 g of ethyl acetate and, if necessary, a required volume of dimethylformamide and then dissolved by heating to 60° C. The resulting solution was admixed with 100 ml of a 5% aqueous solution of gelatin containing 10 ml of a 5% aqueous solution of "Alkanol B" (alkylnaphthalenesulfonates, vailable from E. I. du Pont Co. Inc.) and emulsified and dispersed by means of an ultrasonic dispersing machine to produce a dispersion.

Thereafter, a dispersion of the yellow coupler was added to a silver chlorobromide emulsion (containing 15 mole % silver chloride) so as to give 10 mole % of said yellow coupler to silver and 1,2-bis(vinylsulfonyl)ethane as a hardening agent was then added at a ratio of 10 mg per gram of gelatin. The resultant mixture was coated over a polyethylene-coated paper base so as to provide a coated silver amount of 10 mg/100 $cm^2$. Thus, 4 sorts of color paper samples were prepared containing the yellow couplers as shown in Table 1, respectively.

The sample was then subjected to wedge exposure in a conventional manner and subsequently to development as mentioned below.

| Basic processing steps (with process temperature and process period of time) | |
|---|---|
| (1) Color development | 38° C. 3 minutes 30 seconds |
| (2) Bleach-fixing | 38° C. 1 minute 30 seconds |
| (3) Stabilization or washing | 25–30° C. 3 minutes |
| (4) Drying | 75–80° C. about 2 minutes |

Compositions of Processing Solutions (Color developing tank solution)
- Benzyl alcohol: 15 ml
- Ethylene glycol: 15 ml
- Potassium sulfite: 2.0 g
- Potassium bromide: 0.7 g
- Sodium chloride: 0.2 g
- Potassium carbonate: 30.0 g
- Hydroxylamine sulfate: 3.0 g
- Polyphosphoric acid (TPPS): 2.5 g
- 3-Methyl-4-amino-N-ethyl-N-(β-methanesulfonamidoethyl)aniline sulfate: 5.5 g
- Brightening agent (4,4'-diaminostilbenesulfonic acid derivative): 1.0 g
- Potassium hydroxide: 2.0 g
- Water added to make up a total volume of 1 liter and pH adjusted to 10.20.

(Bleach-fix tank solution)
- Ethylenediaminetetraacetic acid ferric ammonium dihydrate salt: 60 g
- Ethylenediaminetetraacetic acid: 3 g
- Ammonium thiosulfate (70% solution): 100 mil
- Ammonium sulfite (40% solution): 27.5 ml
- pH adjusted to 7.1 with potassium carbonate or glacial acetic acid and water added to make up a total volume of 1 liter.

(Stabilizing solution)
- 5-Chloro-2-methyl-4-isothiazolin-3-one: 1.0 g
- Ethylene glycol: 10 g
- A stabilizing solution was added with sulfite so as to have a concentration of sulfite as indicated in Table I.

Stabilization process was done in a cascade system with a three-tank construction. As a control, washing process was done instead of the stabilization process. Thus, samples were prepared with Sample Nos. 1 to 12.

These samples were stored at 75° C. and relative humidity(RH) of 80% over 4 weeks or irradiated with a Xenon lamp over $2\times10^7$ Lux hours. Then, transmission density was measured at the maximum density part of yellow by means of Sakura photoelectric densitometer "PDA-65" (manufactured by Konishiroku Photo Industry Co., Ltd.) and reduction rate of yellow dye density after storage was determined in terms of percentage. The results are summarized in Table 1.

Comparative coupler (1)

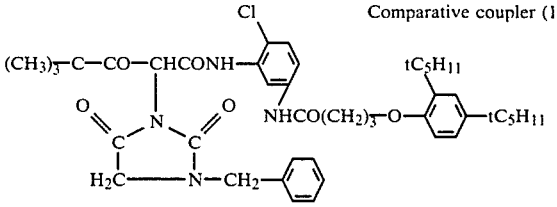

Comparative coupler (2)

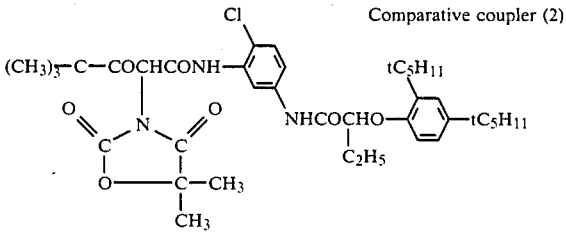

TABLE 1

| Sample No. | Yellow coupler | Processing after bleach-fixing | Sulfite (mole/l) | Reduction rate of yellow dye density (%) 75° C., 80% 4 weeks | Reduction rate of yellow dye density (%) $2 \times 10^7$ Lux hours |
|---|---|---|---|---|---|
| 1 (Comparative) | Comparative coupler (1) | Washing | — | 18 | 24 |
| 2 (Comparative) | Comparative coupler (2) | " | — | 16 | 26 |
| 3 (Comparative) | Comparative coupler (1) | Stabilization | — | 15 | 21 |
| 4 (Comparative) | Comparative coupler (2) | " | — | 14 | 23 |
| 5 (Comparative) | Comparative coupler (1) | " | $2 \times 10^{-3}$ | 13 | 19 |
| 6 (Comparative) | Comparative coupler (2) | " | $2 \times 10^{-3}$ | 13 | 20 |
| 7 (Comparative) | Exemplary compound Y-4 | Washing | — | 12 | 18 |
| 8 (Comparative) | Exemplary compound Y-8 | " | — | 13 | 18 |
| 9 (Comparative) | Exemplary compound Y-4 | Stabilization | — | 11 | 17 |
| 10 (Comparative) | Exemplary compound Y-8 | " | — | 12 | 16 |
| 11 (This invention) | Exemplary compound Y-4 | " | $2 \times 10^{-3}$ | 5 | 9 |
| 12 (This invention) | Exemplary compound Y-8 | " | $2 \times 10^{-3}$ | 7 | 9 |

As apparent from Table 1, it can be seen that the image storage property with time can be greatly improved by processing with the stabilizing solution containing the sulfite and the yellow coupler. This effect has been first accomplished by a combination of the yellow coupler, stabilization process and stabilizing solution containing the sulfite of this invention.

EXAMPLE 2

The color paper samples employed with Samples Nos. 3 and 9 in Example 1 were evaluated in the same manner as done in Example 1 except that amounts of the sodium sulfite incorporated in the stabilizing solution are varied.

TABLE 2

| Sample No. | Yellow coupler | Processing after bleach-fixing | Sodium sulfate (mole/l of stabilizing solution) | Reduction rate of yellow dye density (%) 75° C., 80% 4 weeks | Reduction rate of yellow dye density (%) $2 \times 10^7$ Lux hours |
|---|---|---|---|---|---|
| 13 | Comparative coupler (1) | Stabilizing solution | 0 | 16 | 23 |
| 14 | Comparative coupler (1) | Stabilizing solution | $0.5 \times 10^{-3}$ | 15 | 21 |
| 15 | Comparative coupler (1) | Stabilizing solution | $1.0 \times 10^{-3}$ | 13 | 19 |
| 16 | Comparative coupler (1) | Stabilizing solution | $1.0 \times 10^{-2}$ | 12 | 17 |
| 17 | Comparative coupler (1) | Stabilizing solution | $1.0 \times 10^{-1}$ | 14 | 19 |
| 18 | The coupler of this invention; Exemplary compound Y-4 | Stabilizing solution | 0 | 12 | 19 |
| 19 | The coupler of this invention; Exemplary compound Y-4 | Stabilizing solution | $0.5 \times 10^{-3}$ | 10 | 17 |
| 20 | The coupler of this invention; Exemplary compound Y-4 | Stabilizing solution | $1.0 \times 10^{-3}$ | 5 | 9 |
| 21 | The coupler of this invention; Exemplary compound Y-4 | Stabilizing solution | $1.0 \times 10^{-2}$ | 5 | 8 |
| 22 | The coupler of this invention; Exemplary | Stabilizing solution | $1.0 \times 10^{-1}$ | 7 | 11 |

TABLE 2-continued

| Sample No. | Yellow coupler | Processing after bleach-fixing | Sodium sulfate (mole/l of stabilizing solution) | Reduction rate of yellow dye density (%) 75° C., 80% 4 weeks | $2 \times 10^7$ Lux hours |
|---|---|---|---|---|---|
| | compound Y-4 | | | | |

As apparent from Table 2, a favourable image storage property can be seen where sodium sulfite was present at $1.0\times10^{-3}$ mole or higher in a combination of the yellow coupler with the stabilization process of this invention.

And further, bateria grew in a stabilizing solution containing $1.0\times10^{-1}$ mole of a sulfite after storage at 38° C. over 1 week.

According to this invention, there can be improved stability with lapse of time of the dye image developed by processing a lightsensitive material containing a high speed reactive yellow coupler.

What is claimed is:

1. A method of processing a light-sensitive silver halide color photographic material comprising color developing an imagewise exposed light-sensitive silver halide color photographic material comprising a blue-sensitive silver halide emulsion layer, a green-sensitive silver halide emulsion layer and a red-sensitive silver halide emulsion layer on a base, said blue-sensitive silver halide emulsion layer containing a high speed reactive yellow coupler having a relative coupling reaction rate of not less than 0.3, followed by processing with a processing solution having a fixing ability and then processing with a stabilizing solution without a substantial washing step, said stabilizing solution containing a sulfite in an amount of at least $1\times10^{-3}$ mole per 1 liter of said stabilizing solution.

2. The method according to claim 1, wherein said processing is carried out while replenishing the stabilizing solution with a replenisher solution containing a sulfite in an amount of at least $1\times10^{-3}$ mole per 1 liter of said replenisher solution.

3. The method according to claim 1, wherein said relative coupling reaction rate is not less than 0.5.

4. The method according to claim 1, wherein said high speed reactive yellow coupler is in an amount of $2\times10^{-3}$ to $5\times10^{-1}$ mole per 1 mole of the silver in said blue-sensitive silver halide emulsion layer.

5. The method according to claim 4, wherein said high speed reactive yellow coupler is in an amount of $1\times10^{-2}$ to $5\times10^{-1}$ mole per 1 mole of the silver in said blue-sensitive silver halide emulsion layer.

6. The method according to claim 1, wherein said high speed reactive yellow coupler is in an amount of 55 mole % or more based on the total amount of said yellow couplers.

7. The method according to claim 1, wherein said sulfite is a compound selected from the group consisting of sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, glutaraldehyde bis-sodium bisulfite and succinaldehyde bis-sodium bisulfite.

8. The method according to claim 1, wherein said stabilizing solution contains a chelating agent having a chelate stability constant to a ferric ion of not less than 6.

9. The method according to claim 8, wherein said chelating agent is in an amount ranging from 0.01 to 50 g per 1 liter of said stabilizing solution.

10. The method according to claim 1, wherein said stabilizing solution has a pH value of from 4 to 8.

11. The method according to claim 1, wherein the processing with said stabilizing solution is carried out at a processing temperature of from 15° to 60° C.

12. The method according to claim 9, wherein said chelating agent is in an amount of from 0.05–20 g per liter of said stabilizing solution.

13. The method according to claim 1, wherein said stabilizing solution contains a maximum of 0.1 mol of said sulfite per liter of said solution.

14. The method of claim 11, wherein said processing is carried out at a temperature of from 20° to 45° C.

15. The method of claim 1, wherein said processing with stabilizing solution is carried out for 20 seconds to 10 minutes.

16. The method of claim 15, wherein said processing is carried out for 1 to 5 minutes.

17. The method according to claim 3, wherein said high speed reactive yellow coupler is in an amount of $2\times10^{-3}$ to $5\times10^{-1}$ mole per 1 mole of the silver in said blue-sensitive silver halide emulsion layer;

said high speed reactive yellow coupler is in an amount of 55 mole % or more based on the total amount of said yellow couplers;

said stabilizing solution has a pH value of from 4 to 8; and the processing with said stabilizing solution is carried out at a processing temperature of from 15° to 60° C.

18. The method according to claim 17, wherein said stabilizing solution contains a chelating agent having a chelate stability constant of not less than 6; and said chelating agent is in an amount ranging from 0.01 to 50 g per 1 liter of said stabilizing solution.

19. The method according to claim 18, wherein said high speed reactive yellow coupler is in an amount of $1\times10^{-2}$ to $5\times10^{-1}$ mole per 1 mole of the silver in said blue-sensitive silver halide emulsion layer.

* * * * *